United States Patent [19]

Romanauskas et al.

[11] Patent Number: 4,913,696

[45] Date of Patent: Apr. 3, 1990

[54] SUPPORT ARRANGEMENT FOR A TEMPERATURE SENSOR

[75] Inventors: William A. Romanauskas, Southbury; John F. Williams, New Canaan, both of Conn.

[73] Assignee: E. I. Du Pont De Nemours and Company, Wilmington, Del.

[21] Appl. No.: 228,041

[22] Filed: Aug. 4, 1988

Related U.S. Application Data

[63] Continuation-in-part of Ser. No. 135,449, Dec. 21, 1987.

[51] Int. Cl.[4] ..... B04B 15/02

[52] U.S. Cl. ..... 494/10; 494/84

[58] Field of Search ..... 494/10, 13, 14, 1, 85, 494/84, 83, 60, 61, 43, 46, 38, 39; 210/781, 782; 422/72

[56] References Cited

U.S. PATENT DOCUMENTS

| | | | |
|---|---|---|---|
| 3,174,341 | 3/1965 | Sudo et al. | 73/351 |
| 3,246,688 | 4/1966 | Colburn | 165/39 |
| 3,347,453 | 10/1967 | Georgen | 233/11 |
| 3,409,212 | 11/1968 | Durland et al. | 233/11 |
| 3,600,900 | 8/1971 | Buddecke | 62/3 |
| 3,713,124 | 1/1973 | Durland et al. | 340/209 |
| 3,916,152 | 10/1975 | Hinman | 494/10 |
| 4,205,261 | 5/1980 | Franklin | 494/10 |

OTHER PUBLICATIONS

Service Manual, Beckman Instruments, LBM Ultracentrifuge, pp. 6-3; Drwg. Sht 2/5; Enlargement, (7/84).

Service Manual, Sorvall® OTD Ultracentrifuges, pp. 24-54; 24-55; 24-56; 24-57; 24-62; 24-63; (5/87).

Instruction Manual, Sorvall® Centrifuges, RC-Ultras, p. 6 (9/84); p. 16 (10/84).

Service Manual, Sorvall® Centrifuges, RC-SC, pp. 13-6, pp. 13-7 (12/84).

Service Manual Update, Sorvall® Centrifuges, RT-6000, p. 9/4, p. 9/7-8 (FIG. 9-1) (9/82).

*Primary Examiner*—Robert W. Jenkins

[57] ABSTRACT

A support arrangement for a temperature sensor in a centrifuge is characterized by a generally tubular member coaxially disposed about a portion of the drive shaft. A temperature sensor is positioned on the support arrangement so that it extends into the drive recess of a rotor and there confronts the body of the rotor in a temperature sensing relationship.

19 Claims, 4 Drawing Sheets

SUPPORT ARRANGEMENT FOR A TEMPERATURE SENSOR

CROSS-REFERENCE TO RELATED APPLICATION

This application is a continuation-in-part of application Ser. No. 135,449, filed Dec. 21, 1987 (IP-0698).

BACKGROUND OF THE INVENTION

1. Field of the Invention

The present invention relates to a mounting arrangement for a temperature sensor for a centrifuge instrument.

2. Description of the Prior Art

A centrifuge instrument is an apparatus adapted to separate the components of a sample. To accomplish this end the sample is introduced into one of a plurality of sample receiving cavities disposed in an element called a rotor. The rotor is mounted on the upper end of a shaft that projects upwardly into a chamber or bowl that is supported on the interior of the housing of the centrifuge instrument. The shaft is connected to a motive source which, when activated, rotates the rotor to a predetermined rotational speed. Centrifugal force acts on the sample carried within the cavity and causes the components thereof to separate in accordance with their density.

It is frequently desirable to spin the sample at a specific regulated temperature. For this purpose the centrifuge chamber is refrigerated, as by the provision of refrigeration coils on the exterior of the chamber. The temperature of the rotor and, therefore, the temperature of the sample carried therein is monitored by a temperature sensor which forms a component of a temperature control system.

In some prior-art instruments such as that disclosed in U.S. Pat. No. 3,409,212 (Durland et al.), an infrared radiometer is used as a temperature sensor to measure the energy emitted from the rotor. As is exemplified by this patent the sensor is mounted in a position vertically beneath the rotor. The sensor is operative to detect energy radiating from the undersurface of the rotor and to provide a signal representative of the temperature thereof.

Another known temperature sensing arrangement for a centrifuge instrument physically mounts the sensor in the sidewall of the chamber. A sensor so mounted serves to provide an indication of the temperature of the chamber sidewall. Exemplary of such an arrangement is that contained in the centrifuge instrument sold by E.I. Du Pont de Nemours and Company as the OTD Series ultraspeed centrifuge instruments. These instruments also have a floor mounted radiometer for measuring heat radiated from the bottom of the rotor. The instruments sold by E.I. Du Pont de Nemours & Co., Inc. as the RC-Ultra Series also include a floor mounted radiometer. The instruments also manufactured and sold by the same manufacturer as the RC-5C and the RT-6000 also have floor mounted temperature sensors to measure the chamber floor temperature and/or chamber air temperature.

Mounting the sensor on the sidewall or the floor of the chamber presents an obstruction on these surfaces that interferes with the cleaning of the chamber and that creates air turbulence which adds rotational drag to the rotor and, thus, heat to the system if the rotor is rotated in a nonevacuated environment. This is viewed as disadvantageous.

A mounting arrangement which disposes the temperature sensor on the floor of the chamber may be viewed as disadvantageous for another reason. Such a mounting location for the temperature sensor exposes the same to a relatively high temperature thermal mass in the form of the motive source which is usually mounted directly below the chamber. Exposure to this potential heat source could deleteriously affect the accuracy of the temperature reading provided by the sensor.

It is also noted that a system which mounts a radiation responsive form of temperature sensor to the floor of the chamber of necessity utilizes the bottom surface of the rotor as the radiating surface from which the temperature of the rotor element may be detected. The radiated energy measured by the sensor is a function of the emissivity of the surface at which it is directed. Because the bottom of the rotor is particularly susceptible to damage and wear during normal handling, this surface may become scratched. The imperfections in this surface adversely affect the emissivity of that surface and therefore the accuracy of any temperature measurement based thereon.

In view of the foregoing it is accordingly believed advantageous to provide a support arrangement for a temperature sensor in a centrifuge instrument which does not create additional turbulence, does not expose the sensor to the possibility of erroneous readings due to proximity to other thermal sources, and does not rely upon the emissivity of the bottom surface of the rotor as the surface from which the temperature measurements are made.

SUMMARY OF THE INVENTION

A centrifuge instrument includes a chamber into which a drive shaft upwardly projects. The upper end of the shaft is provided with a mounting spud having a predetermined configuration thereon. The spud is adapted to receive a rotor having a correspondingly configured drive recess therein. In accordance with the present invention a support member extends upwardly into the chamber and has a temperature sensor positioned thereon. The sensor is positioned on the member such that it is disposed within a volume encompassed by the drive recess of the rotor. When received on the support member the sensor is oriented toward the surface of the rotor defining the drive recess. In the preferred arrangement the support member takes the form of a substantially tubular member that coaxially surrounds the shaft. The support member is formed of a thermally insulating material The sensor has a number of electrical leads trailing therefrom. The support member is provided with a bore through which the leads extend. A heat conducting member, typically in the form of a frustoconical annular ring of copper or other heat conducting material, is provided on the support arrangement in an overlying, thermally conductive relationship with respect to the sensor. The heat conducting member has a coating which provides a high emissivity surface. In one embodiment the support member further includes a generally annular skirt portion having a radially inner and a radially outer edge thereon. Electrical conductors extend from the radially inner edge to the radially outer edge of the skirt portion. The conductors are electrically connectible with the leads from the sensor.

BRIEF DESCRIPTION OF THE DRAWINGS

The invention can be fully understood from the following detailed description thereof taken in connection with the accompanying drawings which form part of this application and in which.

DETAILED DESCRIPTION OF THE INVENTION

Figure 1:
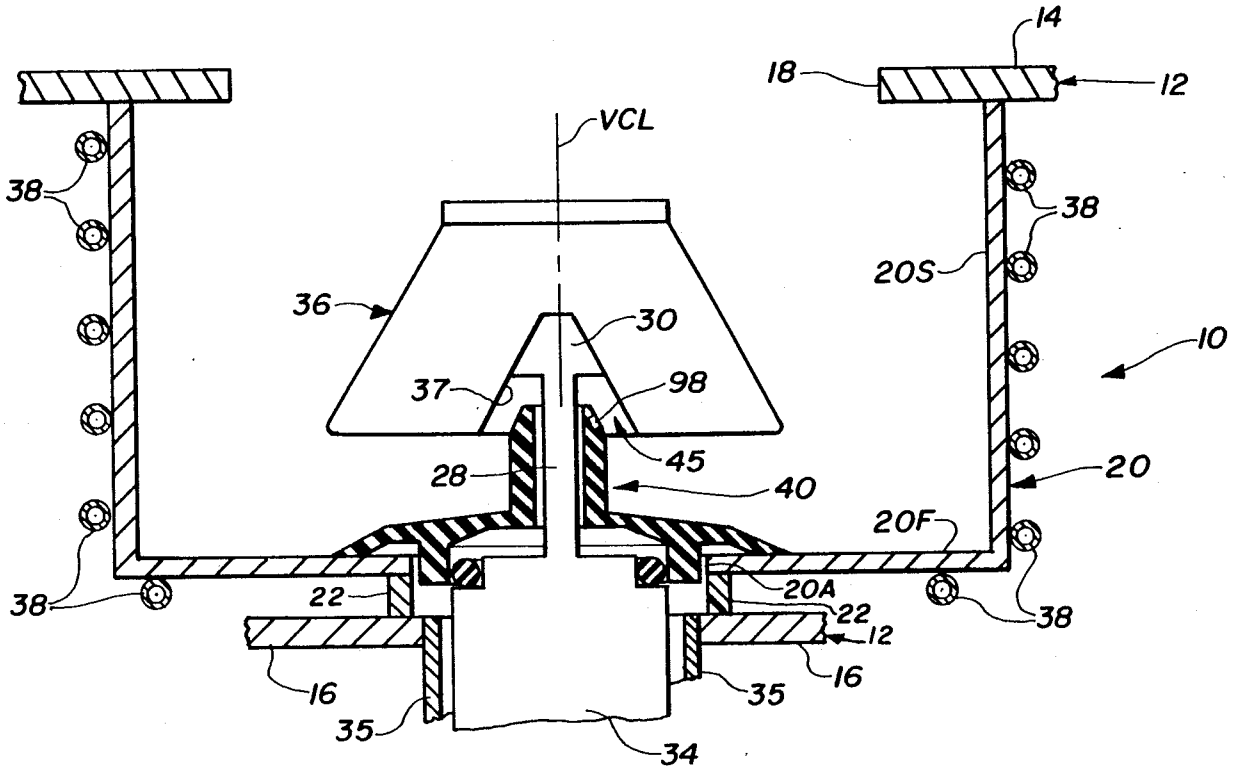
FIG. 1 is a stylized pictorial representation of a centrifuge instrument with which the mounting member of the present invention may be utilized.

Throughout the following detailed description, similar reference numerals refer to similar elements in all figures of the drawings.

Shown in FIG. 1 is a highly stylized pictorial representation of a centrifuge instrument generally indicated by reference character 10 with which a temperature sensor support arrangement generally indicated by reference character 40 may be used. In FIG. 1 the support arrangement 40 is shown only in outline form and its relation to the other elements of the instrument only generally indicated. The centrifuge instrument 10 includes a structural framework 12 formed of relatively massive plate members including an upper or top plate 14 and a central mounting plate 16. The top plate 14 has an access opening 18 therein.

A rotor chamber, or bowl, 20 is suitably mounted, as diagramatically indicated by an abutment ring 22, on the plate 16 of the framework 12. The chamber 20 has a sidewall 20S and a floor 20F. The floor 20F has a central aperture 20A therein. A drive shaft 28 projects through the aperture 20A into the interior of the rotor chamber 20. The drive shaft 28 has a mounting spud 30 on its upper end. The drive shaft 28 is mechanically linked to a source 34 of motive energy such as a brushless dc motor. The motor is itself suitably mounted in a housing 35 which is supported in any convenient fashion to the mounting plate 16 of the framework 12. Access to the chamber 20 is afforded through the opening 18, which is closed by a door (not shown).

The spud 30 has a predetermined configuration associated therewith. Typically the spud 30 is frustoconical in configuration and is adapted to receive a rotor member 36 having a drive recess 37 provided therein. The recess 37 is configured in a manner compatible with the configuration of the spud 30. That is, the recess 37 is configured in a manner which facilitates receipt of the spud 30 thereinto whereby the rotor may be received in a mounted relationship on the shaft 28. When the source 34 is activated rotational motion is imparted to the shaft 28 and the rotor 36 mounted thereon via the spud 30. In this manner the rotor 36 is rotated about the vertical central axis of rotation VCL of the instrument 10 thereby exposing a sample carried in the rotor to a centrifugal force field.

It is common practice to provide a cooling arrangement whereby the sample carried within the rotor 36 may be spun at a predetermined temperature. For the purpose of cooling the chamber 20 refrigeration coils diagrammatically indicated at 38 are disposed on the outer surface of the sidewall and/or the floor of the bowl 20. The present invention relates to a support arrangement 40 for a temperature sensor 98 which serves as an element in a temperature control network (not shown) for the instrument 10.

Figure 2:
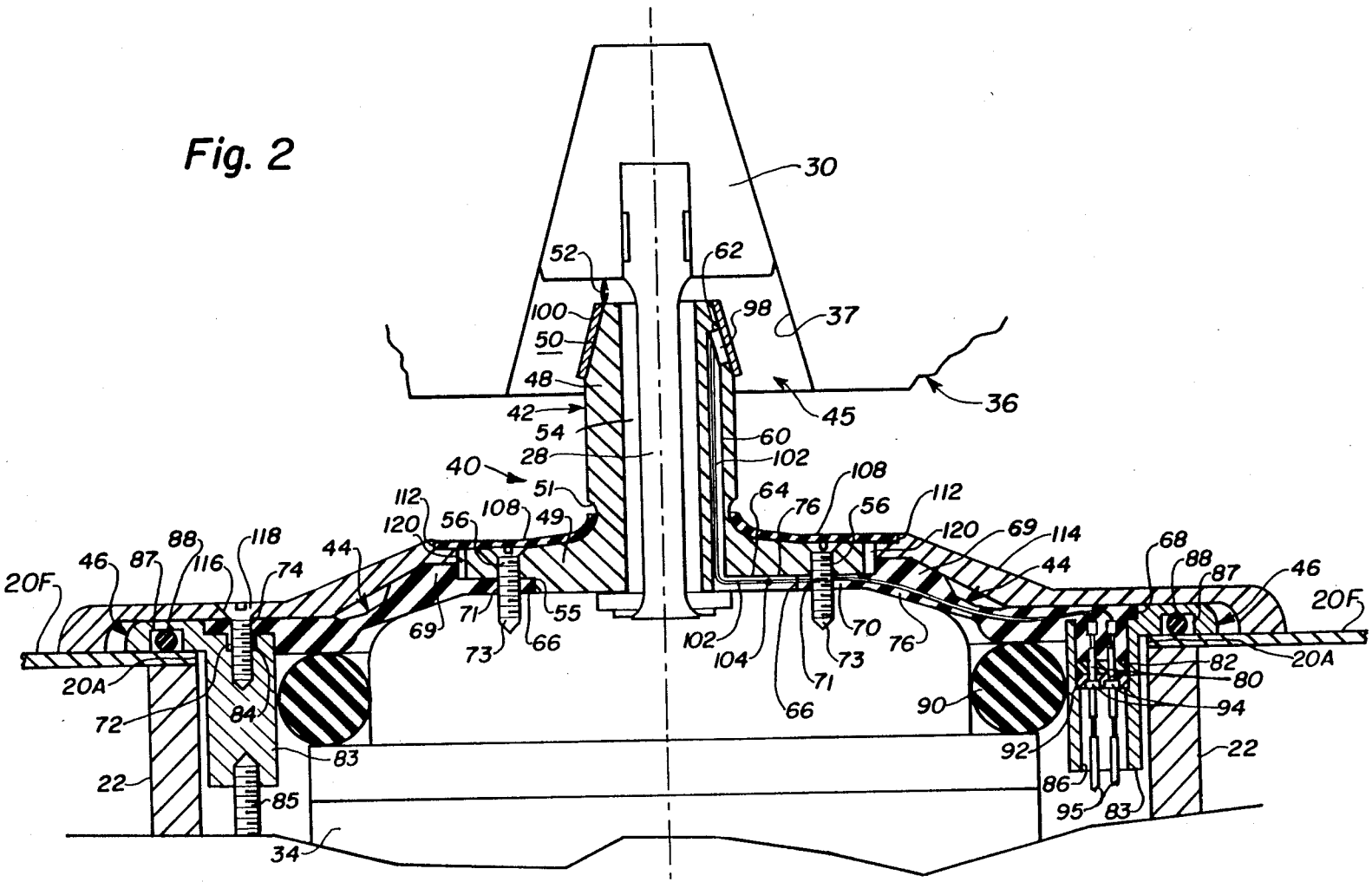
FIG. 2 is a side elevational view entirely in section of the chamber of the centrifuge instrument of FIG. 1 having a temperature mounting arrangement in accordance with the present invention.

Seen in the more detailed drawing shown in FIG. 2 is a first embodiment of the temperature support arrangement, generally indicated by reference character 40. The support arrangement 40 is preferably mounted in a manner to be described on the floor 20F of the chamber 20 about the central apeture 20A. The support arrangement 40 includes a main support member 42 interconnected with an annular skirt portion 44 and an annular collar portion 46. When the support arrangement 40 is fully assembled the main support member 42 extends upwardly into the chamber 20 into the volume encompassed within the recess 37 of the rotor 36, as shown by the reference character 45. The member 42 is disposed in a coaxially surrounding relationship with respect to the shaft 28 of the motive source 34.

The main support member 42 includes a generally elongated tubular portion 48 projecting upwardly from a generally planar flange portion 49. The exterior of the tubular portion 48 has a frustoconical surface 50 adjacent to its upper end and an undercut circumferentially extending notch 51 adjacent the planar annular flange portion 49. The upper end of the member 42 lies a predetermined distance 52 below the spud 30 disposed at the upper end of the shaft 28. The main support member 42 has a bore 54 extending centrally and axially therethrough. The undersurface of the flange 49 is undercut, as at 55. An array of bolt openings 56 extends through the flange 49.

A bore 60 extends through the tubular portion 48. The axis of the bore 60 is generally parallel to the axis of the bore 54, although it need not be so arranged. The upper end of the bore 60 opens at a mouth 62 that interrupts the frustoconical surface 50 of the tubular portion 48 at a predetermined angular location thereon. The lower end of the bore 60 communicates with a radially extending passage 64, in the form of a groove, provided on the undersurface of the flange portion 49. The member 42 is molded from a thermally insulating material such as a glass beaded epoxy sold by Dow Chemical Company as Versamid 14D having glass microbeads such as sold by 3M Company as product number A16/500. Preferably the beads are the size 177 micrometers. The specific gravity of the material is equal to approximately 0.8. The material is chosen for its thermal insulating qualities and strength.

The skirt portion 44 is a generally annular member having a radially inner edge 66 and a radially outer edge 68 thereon. The inner edge 66 is provided with a shoulder 69 having a radially inwardly extending lip 70. The lip 70 is received within the undercut 55 in the flange portion 49. The lip 70 has openings 71 therein which align with the openings 56 in the flange 49. The skirt 44 is connected to the flange portion 49 by an adhesive such as the two part urethane adhesive sold by Conap, Inc., Orlean, N.Y., under the designation "AD-20." The flange 49 and the skirt portion 44 are attached to the end bell of the motor 34 by means of an array of mounting bolts 73 that pass through the aligned bolt openings 56, 71.

The skirt 44 is itself formed of a suitable flexible acoustical damping maaterial such as polyurethane. Suitable for use is the material sold by Sorbothane Inc., Kent, Ohio as "Sorbothane." Alternatively the three part urethane material sold by Conap Inc under the designation "4010" may be used. An annular mounting ring 72 extends substantally circumferentially around the undersurface of the skirt 44 adjacent to the radially outer edge 68 thereof. Bolt openings 74 (one of which is illustrated) are provided adjacent the radially outer edge 68 of the skirt 44.

The skirt 44 is provided with electrical conductors 76 which are molded into the material thereof. The conductors 76 extend in a generally radial fashion from a point adjacent the inner edge 66 to a point adjacent the outer edge 68 thereof. The ends of the conductors 76 are stripped of their insulation adjacent the radially inner edge 66. The conductors 76 terminate in pin terminals 80 that are carried in a connector plug 82. The plug 82 has barbs (not shown) which facilitate the insert molding of the plug 82 into the material of the skirt 44. The plug 82 is itself formed of a glass filled phenolic plastic. In this manner it may be appreciated that an electrical interconnection may be effected over the conductors 76 between a device connected to the stripped radially inner ends of the conductors 76 and a network connected at the radially outer terminals 80 supported in the plug 82.

The collar portion 46 is itself an annular member having an enlarged abutment 83 with a circumferential groove 84 formed therein. The collar 46 is attached to the mounting plate 16 (not seen in FIG. 2) by an array of bolts 85. One part of the abutment 83 is hollowed to define a recess 86. The undersurface of the collar 46 is provided with a channel 87 which serves to retain an O-ring seal 88. The seal 88 assists in maintaining the sealed integrity between the support arrangement 40 and the floor 20F of the chamber 20 in the vicinity of the aperture 20A thereof. A silicone O-ring seal 90 is disposed between the abutment 83 and the motor 34. The seal 90 provides a vacuum seal for the chamber 20 and damping for the motor 34.

An electrical socket 92 is received within the hollow recess 86 of the collar 46. The socket 92 carries a number of receptacles 94 corresponding to the terminals 80 in the plug 82. In the assembled relationship the mounting ring 72 of the skirt 44 is received within the groove 84. The fully assembled arrangement is shown in FIG. 2. The electrical terminals 80 carried by the plug 82 are received within the receptacles 94 carried by the socket 92. They may be interconnected with the temperature control system (not shown) as by lines 95.

A temperature sensor 98, such as that sold by Analog Devices under Model Number AD590, is bonded to an annular frustoconical, heat conducting, metallic ring member 100. The ring 100 is made of copper in the preferred case. The sensor 98 is bonded to the ring member 100 by a thermally conductive epoxy such as that sold by Wakefield Engineering, Wakefield, Mass. as "Delta Bond 152." The ring 100 is itself received on the upper surface 50 of the tubular portion 49 of the support member.

The ring member 100 is bonded in place using the adhesive "AD-20" discussed above. The exterior of the ring 100 is coated with the epoxy paint such as that sold by Armstrong Products Company, Warsaw, Ind., to provide a high surface emissivity characteristic and to prevent corrosion. The paint sold under designation "E-31551-5N" may be used. The paint is cured by baking. The leads 102 from the sensor 98 project through the bore 60 which extends through the tubular portion 48 of the main support member 42. The leads 102 are potted within the bore 60 using the adhesive "AD-20" discussed above. (The potting is not shown for clarity.) The ends of the leads 102 are stripped and connected by soldering to the stripped ends of the conductors 76, as shown at 104.

A sealing boot 108 formed of an elastomeric material (e.g., neoprene) is provided over the surface of the flange portion 49 of the main support member 42 and extends from a free end received in the exterior notch 51 to a radially outwardly end thereof. The radially outer end of the boot 108 is received within a notch 112 provided on the inner edge of a generally annular metallic (aluminum) heat shield 114. The boot 108 is secured to the heat shield 114 by an epoxy adhesive such as that sold by Loctite Corp. of Newington, Conn. as "Super Bonder 495." The shield 114 has openings 116 thereon which register with the openings 74 in the skirt 44. The heat shield 114 itself overlies the skirt portion 44 and the collar portion 46 and is maintained in position within the chamber 20 by an array of bolts 118 which extend through the openings 116 in the shield 114 and the openings 74 in the skirt 44 into enlarged abutment portion 83 of the collar portion 46.

A gap 120 is formed between the radially inner edges of the shoulder 69 and the shield 114 and the radially outer edge of the flange 49 on the main support 42. This gap 120 allows pivotal motion of the motor 34 about its mount (not shown).

In operation it may be seen that the location of the temperature sensor 98 in the manner above described disposes the temperature sensor 98 within the volume encompassed within the drive recess 37 of the rotor 36 and orients the sensor 98 toward and in a heat sensing relationship with that surface of the rotor 36 defining the recess 37. Since this surface is not generally subjected to excessive wear its radiating emissivity characteristic remains substantially constant. By disposing the sensor 98 in a temperature sensing relationship with the surface of the rotor defining the recess 37 the constancy of its emissivity characteristic may be used to full advantage in determining the temperature of the rotor 30. Moreover, so positioning the sensor 98 leaves the sidewall 24S and the floor 24F of the chamber 20 free of any obstructions.

Figure 3:
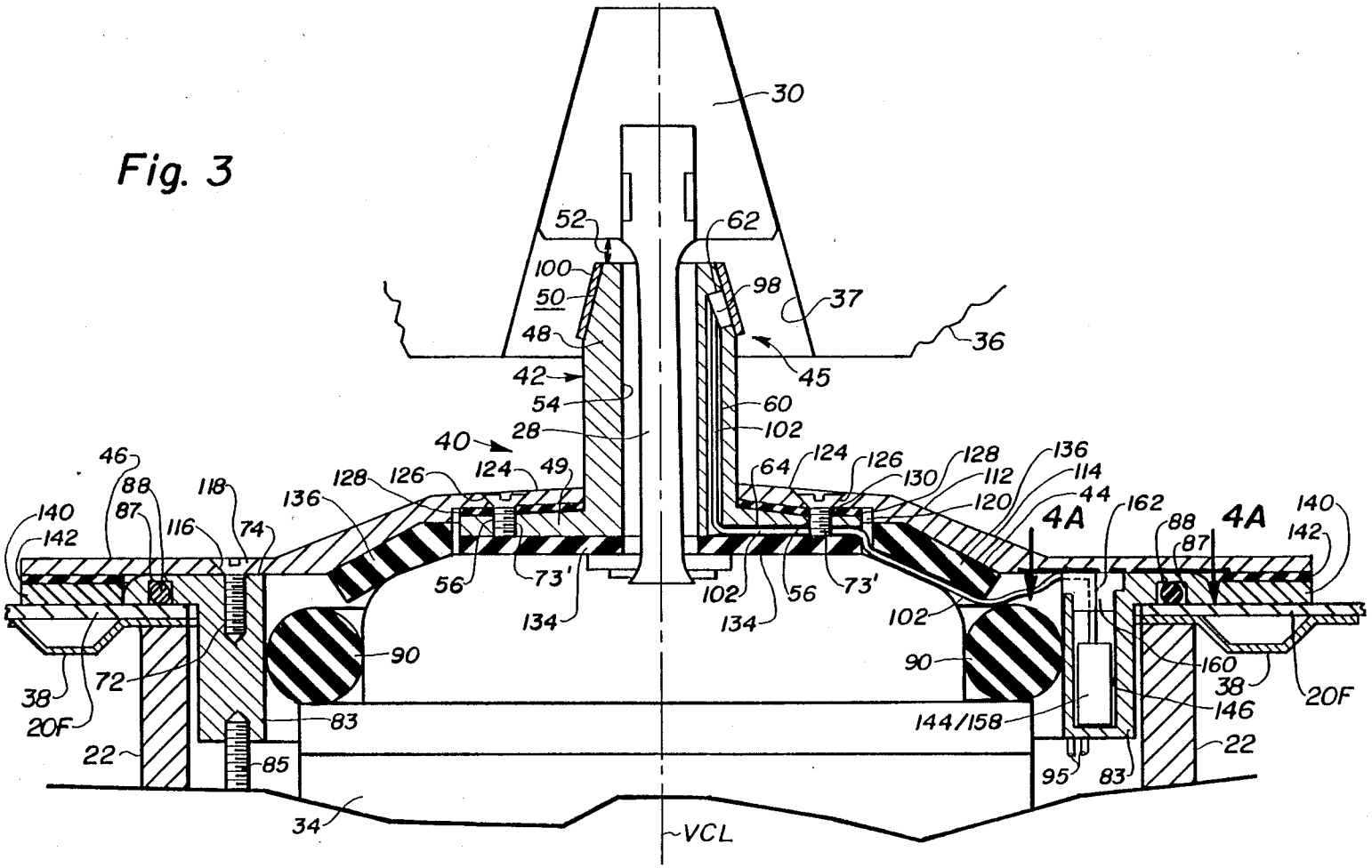
FIG. 3 is a side elevational view generally similar to FIG. 2 showing an alternate mounting arrangement for a heat shield.

An alternate embodiment of the present invention is shown in FIG. 3. The differences between FIGS. 2 and 3 relate generally to the manner in which the support arrangement 40 is mounted within the instrument 10. In particular, in the alternate embodiment shown in FIG. 3 the heat shield 114 is mounted in a manner which is believed more effective in extracting heat from the rotor 36. In FIG. 3 the temperature differential between the heat shield 114 and the rotor 36 is increased by improving the thermal path between the refrigerant in the coils 38 and the shield 114. In addition, conduction of heat from the motor 34 to the sensor 98 is minimized.

In the arrangement shown in FIG. 3 the annular skirt 44 is ommitted and the leads 102 from the sensor 98 are directly connected to the lines 95 in a manner to be described. The leads 102 are formed of flexible circuits, generally similar to ribbon cable. Suitable for use as the leads 102 is the ribbon cable sold by BTL Division of Allectropac Inc., Toronto, Ontario, Canada. The cable has 0.003 by 0.015 inches copper leads encapsulated in a polyimide film such as that sold by E.I. Du Pont de Nemours and Company under the trademark KAPTON. The sealing boot 108 is also ommitted. The heat shield 114 is provided with an annular flange portion 124 formed integrally with the remainder of the shield. The flange 124 extends radially inwardly to a position closely adjacent to the lower end of the tubular portion 48 of the main support member 42. An array of bolt openings 126 is provided in the flange portion 124 of the heat shield 114. The openings 126 align with the openings 56 in the flange portion 49 of the main support member 42. An elastomeric gasket 128, preferably formed of forty durometer silicone rubber, is sandwiched between the undersurface of the flange portion 124 of the heat shield 114 and the upper surface of the flange portion 49 of the main support member 42. The gasket 128 has openings 130 therein which correspond in number and position to the openings 56 and 126. The gasket 128 is provided to fill the space between the shield 114 and the flange 49 to prevent moist air from condensing in that space.

The main support member 42 is mechanically supported by the heat shield 114 by bolts 73' which extend through the registered openings 126, 130 and 156 respectively provided in the flange 124, the gasket 128, and the flange portion 49. In this embodiment the openings 56 in the flange portion 49 of the main support member 42 are themselves threaded so that the heat shield 114 can mechanically support the member 42. In actual practice the threads in the openings 56 may be provided by self-clinching standoffs (not shown) which are press fit into the flange portion 49. Suitable for use as the standoffs are those manufactured by Penn Engineering and Manufacturing Company, Danboro, Pa., under model number SOS-M4-4. In this manner the main support member 42 is supported so as to be spaced away from and out of direct thermal contact with the surface of the end bell of the motor 34. Thus, conduction of heat from the motor 34 into the main support member 42 is minimized, so that the heat generated by the motor 34 will not influence the temperature sensed by the sensor 98.

An annular insert 134 of open cell polyurethane foam, such as that manufactured and sold as the adhesive backed, Type M foam by Soundcoat Company, Deerpark, N.Y. is adhered to the undersurface of the flange portion 49 of the main support member 42. A second insert 136 of the same material is adhered to the undersurface of the heat shield 114. The inserts 134, 136 occupy substantially all of the space defined between the end bell of the motor 34 and the undersurfaces of the flange proiton 49 and the heat shield 114 to thereby minimize any condensation effects that could occur in that region.

It should be noted that the above discussed structural modificatons permit some degree of vertical freedom of movement for the seal 90 during evacuation of the chamber 20. However, the seal 90 still is operable to maintain sealed integrity between the abutment 83 and the motor 34.

An annular metallic (aluminum) spacer 140 is disposed on the floor 20F of the chamber 20 in a position generally concentric with the shaft 28 of the motor 34. The spacer 140 is coated with the same epoxy paint used to coat the ring member 100. The spacer 140 is held to the floor 20F using any suitable expedient such as the repairable thermal conductive adhesive manufactured and sold by the Electronics Division of Loctite Corporation of Newington, Conn. under the designation number 00241. A thermally conductive pad 142 is located on the spacer 140. Suitable for use as the pad 142 is the pad manufactured by Bergquist Company, Minneapolis, Minn., under the designation "Q-Pad". The pad 142 is held in place between the undersurface of the heat shield 114 and the spacer 140 when the shield is secured by the bolts 118 to the abutment 83. The purpose of the spacer 140 and the pad 142 is to provide an effective thermal path between the heat shield 114 and the floor 20F of the chamber 20. Preferably, the spacer 140 is located directly above one of the refrigeration coils 38 attached to the chamber 20.

Figure 4B:
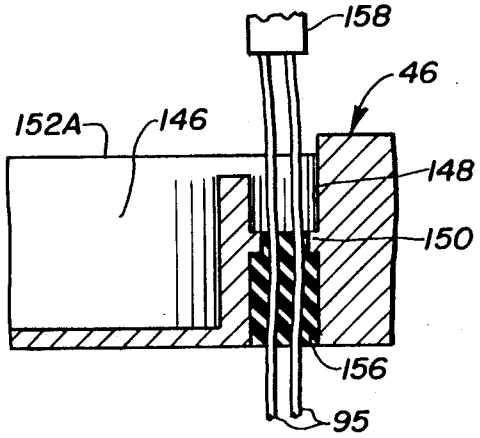
FIGS. 4A and 4B are, respectfully, a fragmentary plan view of a portion of the collar portion of the mounting member taken along view lines 4A—4A in FIG. 3 and a sectional view taken along view lines 4B—4B in FIG. 4A.
Figure 4A:
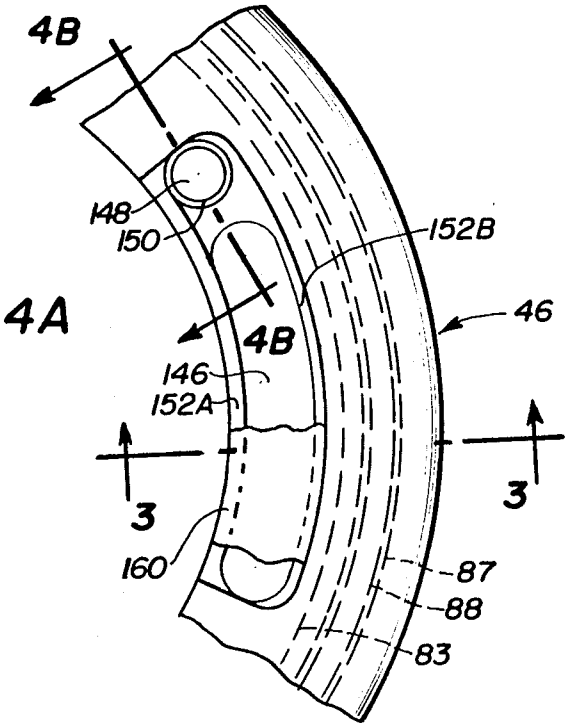

The interconnection of the cable 102 to the lines 95 may be understood from the following discussion. The free end of the cable 102 is provided with a connector 144, such as that sold by the Interconnect and Packaging System Division of E.I. Du Pont de Nemours and Company as Model 67954-003. As seen in FIGS. 4A and 4B, the collar 46 is modified by providing an arcuate groove 146 therein. The groove 146 defines a pocket in the abutment portion 83 of the collar 46. The groove 146 communicates with a through bore 148 that has a shoulder 150 thereon located approximately midway through the bore. The radially inner edge and radially outer of the collar 46, in the vicinity of the groove 146, are milled to define ledges 152A, 152B respectively. The groove 146 is accessible over the radially inner ledge 152A. The leads 95 extend upwardly through the bore 148 and are potted using a clear epoxy potting compound 156 such as that sold by Dexter Midland Company, Rocky Hill, Conn. The potting compound is disposed in the region around the lines 95 from the top of the shoulder 150 to the bottom of the abutment 83 (FIG. 4B). The potting compound 156 is provided to form a vacuum seal in the bore 148. The ends of the lines 95 projecting through the opening 148 are provided with a corresponding connector 158, which engages the connector 144 at the end of the cable 102 thereby to electrically interconnect the cable 102 to the lines 95. The cable 102 and the joined connectors 144, 158 (with a polarizing shroud such as that sold by Interconnect and Packaging Systems Division of E.I. du Pont de Nemours & Co., Inc. as Model 76955-003) are received within the groove 146. An elastomeric plug 160 is seated on the ledges 152A, 152B to cover the groove 146. The plug 160 is slit, as at 162, to full depth inwardly from one end thereof for approximately one-third of its long dimension so that the cable 102 passes through the plug 160 into the groove 146. In FIG. 3, the plug 160 is not cross hatched, for clarity of illustration.

It should be understood that, in accordance with either embodiment of the invention, the temperature sensor 98 need not project fully into the volume encompassed by the drive recess 37. Thus, it should be construed as lying within the contemplation of this invention to utilize the mounting arrangement 40 within the scope of this invention to dispose a sensor 98 proximally to (e.g., not wholly or partially within) the volume encompassed by the recess 37 so long as the sensor 98 lies in a temperature sensing relationship with the surface of the rotor 36 defining the recess 37.

Those skilled in the art, having the benefit of the teachings of the present invention, may impart numerous modifications hereto. Such modifications are, however, to be construed as lying within the contemplation of the present invention, as defined by the appended claims.

What is claimed is:

1. The centrifuge instrument having a chamber, a drive shaft projecting into the chamber, the drive shaft having an upper end having a predetermined configuration, the shaft being able to receive a rotor member in a mounted relationship thereon, the rotor member having a surface thereon and having a drive recess configured compatibly to the configuration of the upper end of the shaft, the improvement comprising:

a support member extending upwardly in the chamber the support member being generally tubular and being disposed in a coaxial surrounding relationship with the shaft, the support member having an upper end thereon that lies below the upper end of the shaft; and a temperature sensor positioned at a predetermined location along the support member such that, when a rotor is received on the shaft, the sensor is disposed proximally to the drive recess in a temperature sensing relationship with the surface of the rotor defining the drive recess.

2. The centrifuge instrument of claim 1 wherein the temperature sensor has at least one wire lead emanating therefrom, and wherein the support member has a bore therein through which the lead from the temperature sensor extends.

3. The centrifuge instrument of claim 2 wherein the support member has a generally annular skirt portion thereon, the skirt portion having a radially inner edge and a radially outer edge thereon, the skirt portion having an electrical conductor extending therethrough, the conductor having a first end and a second end thereon, the first end of the electrical conductor being disposed adjacent the radially inner edge of the skirt portion and a second end disposed adjacent the radially outer edge of the skirt portion, the first end of the electrical conductor being connectible to the wire lead from the temperature sensor.

4. The centrifuge instrument of claim 2 further comprising a metallic heat conducting member secured to the support member, the heat conducting member overlying the temperature sensor and being disposed in a thermally conductive relationship therewith.

5. The centrifuge instrument of claim 2 wherein a source of motive energy is mounted below the chamber, the motive source has an end surface thereon, the drive shaft extending from the motive source, wherein the improvement further comprises:

the support member has an undersurface thereon, the support member being mounted within the instrument such that the undersurface of the support member is spaced from the end surface of the motive source.

6. The centrifuge instrument of claim 1 further comprising a metallic heat conducting member secured to the support member, the heat conducting member overlying the temperature sensor and being disposed in a thermally conductive relationship therewith.

7. The centrifuge instrument of claim 1 wherein a source of motive energy is mounted below the chamber, the motive source has an end surface thereon, the drive shaft extending from the motive source, wherein the improvement further comprises:

the support member has an undersurface thereon, the support member being mounted within the instrument such that the undersurface of the support member is spaced from the end surface of the motive source.

8. In a centrifuge instrument having a chamber defined by a floor and an upstanding sidewall, the floor having a central aperture therein, a motive source mounted beneath the chamber, a drive shaft emanating from the source and projecting through the aperture into the chamber, the shaft having an upper end thereon, a mounting spud disposed at the upper end of the shaft, the mounting spud having a predetermined exterior configuration thereon, a rotor member having a body with a drive recess formed in the body, the recess being configured correspondingly to the spud, the spud being adapted to extend into the correspondingly configured drive recess formed in the body of the rotor element thereby to mount the rotor on the shaft, the improvement comprising:

a generally tubular support member projecting upwardly into the chamber, the support member coaxially surrounding a portion of the shaft disposed within the chamber, the support member having an upper end thereof that lies a predetermined distance beneath the mounting spud; and a temperature sensor positioned at a predetermined location on the support member such that, when a rotor is received on the spud, the sensor is disposed within the drive recess of the rotor in a temperature sensing relationship therewith.

9. The centrifuge instrument of claim 8 further comprising a metallic heat conducting member secured to the support member, the heat conducting member overlying the temperature sensor and being in a thermally conductive relationship therewith the sensor.

10. The centrifuge instrument of claim 9 wherein the heat conducting member is an annular member formed of copper.

11. The centrifuge instrument of claim 10 wherein the sensor is located adjacent the upper end of the support member and wherein the heat conducting member is a frustoconical annular ring.

12. The centrifuge instrument of claim 9 wherein the temperature sensor has at least one lead emanating therefrom, and wherein the support member has a bore therein through which the lead extends.

13. The centrifuge instrument of claim 12 wherein the support member has a generally annular skirt portion thereon, the skirt portion having a radially inner edge and a radially outer edge thereon, the skirt portion having an electrical conductor extending therethrough, the conductor having a first end and a second end thereon, the first end of the electrical conductor being disposed adjacent the radially inner edge of the skirt portion and a second end disposed adjacent the radially outer edge of the skirt portion, the first end of the electrical conductor being connectible to the wire lead from the temperature sensor.

14. The centrifuge instrument of claim 12 wherein the source of motive energy has an end surface thereon, wherein the improvement further comprises:

the support member has an undersurface thereon, the support member being mounted within the instrument such that the undersurface of the support member is spaced from the end surface of the motive source.

15. The centrifuge instrument of claim 9 wherein the source of motive energy has an end surface thereon, wherein the improvement further comprises:

the support member has an undersurface thereon, the support member being mounted within the instrument such that the undersurface of the support member is spaced from the end surface of the motive source.

16. The centrifuge instrument of claim 8 wherein the temperature sensor has at least one lead emanating therefrom, and wherein the support member has a bore therein through which the lead extends.

17. The centrifuge instrument of claim 16 wherein the support member has a generally annular skirt portion thereon, the skirt portion having a radially inner edge and a radially outer edge thereon, the skirt portion having an electrical conductor extending therethrough, the conductor having a first end and a second end thereon, the first end of the electrical conductor being disposed adjacent the radially inner edge of the skirt portion and a second end disposed adjacent the radially outer edge of the skirt portion, the first end of the electrical conductor being connectible to the wire lead from the temperature sensor.

18. The centrifuge instrument of claim 16 wherein the source of motive energy has an end surface thereon, wherein the improvement further comprises:

the support member has an undersurface thereon, the support member being mounted within the instrument such that the undersurface of the support member is spaced from the end surface of the motive source.

19. The centrifuge instrument of claim 8 wherein the source of motive energy has an end surface thereon, wherein the improvement further comprises:

the support member has an undersurface thereon, the support member being mounted within the instrument such that the undersurface of the support member is spaced from the end surface of the motive source.

* * * * *